US010928164B2

(12) United States Patent
Phillips

(10) Patent No.: US 10,928,164 B2
(45) Date of Patent: Feb. 23, 2021

(54) BALLISTIC MULTILAYER ARRANGEMENT

(75) Inventor: Roland Phillips, Großbritannien (GB)

(73) Assignee: RELION protection systems AG, Wienacht Tobel (CH)

( * ) Notice: Subject to any disclaimer, the term of this patent is extended or adjusted under 35 U.S.C. 154(b) by 202 days.

(21) Appl. No.: 14/240,424

(22) PCT Filed: Aug. 22, 2012

(86) PCT No.: PCT/IB2012/001627

§ 371 (c)(1),
(2), (4) Date: Apr. 11, 2014

(87) PCT Pub. No.: WO2013/027114

PCT Pub. Date: Feb. 28, 2013

(65) Prior Publication Data

US 2014/0208930 A1 Jul. 31, 2014

(30) Foreign Application Priority Data

Aug. 22, 2011 (CH) ..... 1361/11
Aug. 22, 2011 (DE) ..... 10 2011 052 879.2
Sep. 11, 2011 (DE) ..... 10 2011 053 484.9

(51) Int. Cl.
*F41H 5/04* (2006.01)

(52) U.S. Cl.
CPC ..... *F41H 5/0421* (2013.01); *F41H 5/0407* (2013.01); *F41H 5/0414* (2013.01); *F41H 5/0428* (2013.01); *F41H 5/0457* (2013.01); *F41H 5/0471* (2013.01); *F41H 5/0478* (2013.01); *F41H 5/0492* (2013.01)

(58) Field of Classification Search
None
See application file for complete search history.

(56) References Cited

U.S. PATENT DOCUMENTS 4,186,648 A 2/1980 Clausen et al.
5,120,380 A * 6/1992 Strachan ..... B29C 70/025 156/164
5,830,548 A * 11/1998 Andersen ..... B28B 1/00 206/524.3
8,286,919 B2 * 10/2012 Gerken et al. ..... 244/133
2003/0150185 A1 * 8/2003 Godeke ..... E04C 1/41 52/576

(Continued)

FOREIGN PATENT DOCUMENTS

DE 102007025894 12/2008
EP 0237095 9/1987
WO 2008/060648 5/2008

OTHER PUBLICATIONS

Poraver; Material Safety Data Sheet; pp. 1-4; Feb. 12, 2007.*

(Continued)

*Primary Examiner* — Stephen Johnson
(74) *Attorney, Agent, or Firm* — Renner, Otto, Boisselle & Sklar, LLP

(57) ABSTRACT

The invention relates to a ballistic layer for a ballistic multilayer arrangement (1), wherein it is formed by an absorption layer (2, 2*a*, 2*b*) that entirely or largely comprises expanded glass (21) and by a ballistic multilayer arrangement (1) with an impact side (A) and a back side (B), wherein at least one of the layers is formed by such an absorption layer (2, 2*a*, 2*b*) that entirely or largely comprises expanded glass (21).

19 Claims, 8 Drawing Sheets

(56) References Cited

U.S. PATENT DOCUMENTS

| | | | | |
|---|---|---|---|---|
| 2004/0251573 | A1* | 12/2004 | Schmid | C04B 28/26 264/109 |
| 2006/0162279 | A1* | 7/2006 | Bergan | B32B 15/04 52/783.1 |
| 2007/0227814 | A1* | 10/2007 | Schabel, Jr. | 181/288 |
| 2008/0096018 | A1* | 4/2008 | Zhang | C04B 14/24 428/402 |
| 2009/0090236 | A1* | 4/2009 | Misencik | E04H 9/10 89/36.02 |
| 2011/0023763 | A1* | 2/2011 | Morgan | C08G 59/50 114/85 |
| 2013/0273341 | A1* | 10/2013 | Albertelli | B32B 5/18 428/218 |
| 2014/0318778 | A1* | 10/2014 | Skala | E21B 43/267 166/280.1 |

OTHER PUBLICATIONS

Performance Specification Deck Covering Underlay Materials; Sep. 18, 2008; pp. 1-19.*

Department of Defense Test Method Standard; MIL-STD-662F; Dec. 18, 1997; 23 pages.*

International Search Report for corresponding patent application No. PCT/IB2012/001627 dated Dec. 18, 2012.

* cited by examiner

BALLISTIC MULTILAYER ARRANGEMENT

The invention relates to a ballistic multilayer arrangement to defend against projectiles or other highly-accelerated components.

BACKGROUND

Ballistic plates are used in all kinds of armour, be it on vehicles, aircraft, buildings or directly portable on persons. In most instances the very heavy weight of the plates is disadvantageous, which plates necessarily have to be of sufficient thickness to satisfy the requirements of a particular ballistic level.

The above is disadvantageous, for example in passenger transport vehicles that by means of armour comprising thick steel plates have to provide protection against ballistic threats, which plates as a result of the heavy weight also render the vehicles slow and cumbersome.

For this reason in the further state of the art multilayer plates are used, which are, however, expensive to manufacture or do not meet the high but required ballistic levels. FIG. 5 shows a known ballistic plate 9 which on the impact side comprises a ceramic plate 91 by means of which a projectile is to be decelerated, and at best partially disaggregated, followed by one or several layers of aramid fibres 92, and finally a steel plate 93.

In particular in the case of modern projectiles with ceramic material cores (for example tungsten carbide) or high-energy projectiles, as a result of the layer thicknesses necessary for defense these plates become too heavy or very expensive to manufacture.

SUMMARY OF THE INVENTION

The invention provides a ballistic multilayer arrangement that is both reliable and saves material during manufacture.

According to the invention according to a first aspect of the invention it is proposed to design a ballistic layer for a ballistic multilayer arrangement in such a manner that it is formed by an absorption layer that entirely or largely comprises expanded glass. Suitable foam glass that has the same characteristics is included in the sense of the invention.

In this manner stopping the incoming projectile or fragment becomes possible in a particularly effective manner. The energy is absorbed to a high degree by the absorption layer.

The term "expanded glass" refers to foamed glass with small gas-filled or air-filled pores. Expanded glass can be produced in various grain sizes.

A very economical and thus advantageous variant of the invention provides for the expanded glass to be present in the form of sintered expanded-glass granulate.

In the sense of the invention the layer can be provided so as to be flexible as a mat or a blanket, or in particular with the further embodiments as a rigid plate.

As a rigid composite structure the ballistic layer can be present as expanded glass, and according to a further advantageous embodiment of the invention in the form of sintered expanded-glass granulate.

A particularly advantageous and thus preferred embodiment of the invention provides for the expanded glass to be present in the form of expanded-glass granulate held in a dense packing or fill by means of a matrix that encloses the expanded-glass granulate. In this arrangement the granulate beads tightly adjoin each other and are at least partly enclosed by the matrix.

Preferably, the expanded-glass granulate comprises a granulate size of 0.01 mm to 5 mm.

Furthermore, it is preferred if the expanded glass or expanded-glass granulate predominantly comprises $SiO_2$. Further preferably as further ingredients the expanded glass or expanded-glass granulate comprises $Na_2O$ and CaO, and equally preferably as further ingredients comprises a small amount, in each case below 10 percent weight by weight, of $Al_2O_3$ and/or MgO and/or $K_2O$.

According to a particularly advantageous embodiment of the invention the matrix of the expanded-glass granulate comprises a synthetic material or a synthetic resin or a mixture of synthetic material/synthetic resin, which mixture is, in particular, impact-resistant. This makes it possible to achieve particularly good absorption of the energy of the projectile.

Consequently, it is advantageously provided that the synthetic material mixture comprises polyurethane and/or polyethylene and/or epoxy resin and/or silicon and/or an impact-proof synthetic material and/or an impact-resistant synthetic material.

According to a further embodiment of the invention, a ballistic multilayer arrangement with an impact side and a back and a ballistic layer according to any one of claims 1 to 9 is proposed, wherein at least one of the layers of the ballistic multilayer arrangement is formed by a multilayer fibre layer comprising layers of aramid fibres or comparable fibres, wherein said multilayer fibre layer is, in particular, designed in the form of a woven material or a multilayer woven material.

Advantageously it is provided for the at least one of the layers to be formed by a plate comprising fine stone or natural stone or ceramic or a ceramic mix, in particular comprising a composite-structure material. In this manner a projectile can be decelerated very effectively by means of the necessary destruction force of the plate, and can be partially disaggregated and moved from its trajectory, which in the following layers improves the effectiveness by a broadened contact surface.

Lightweight projectiles or low-energy projectiles can be entirely kept off by such a layer.

When penetrating the layers a projectile can also very effectively be deflected by a spall layer, preferably a spall layer provided according to an improvement of the invention. To this effect it is proposed that the spall layer is formed by spalls comprising spalls of ceramic or ceramic metal or fine stone or natural stone, which spalls are bound in a matrix.

Preferably at least one layer of the ballistic multilayer arrangement is formed by a metal plate.

Advantageously at least one layer can be formed by a highly tenacious synthetic layer that in this arrangement can preferably be formed by the highly tenacious synthetic layer of the matrix of the absorption layer.

Advantageously the arrangement is surrounded by a synthetic cover layer or a fibre-reinforced synthetic braiding layer at least on one side of the impact side and the back.

Consequently the structure of regions beside an impact are better preserved and, for example, a fractured or broken ceramic plate retains its function in a region beside a location of impact.

Preferably in the layer sequence the absorption layer is followed at least on one of its sides by a fibre layer.

In a plate-like design, apart from the absorption plate, advantageously at least one fine stone layer, natural stone layer or ceramic layer, a fibre layer and a metal layer are provided.

A particular embodiment provides for the layer sequence to be selected as follows:

an enveloping layer, a ceramic/fine stone/natural stone layer, in particular followed by a metal layer, a fibre layer and an absorption layer sequence, a metal layer.

Further advantageous embodiments are stated in the further subordinate claims or their possible subordinate combinations.

BRIEF DESCRIPTION OF THE DRAWINGS

Below, the invention is explained in more detail with reference to the drawings. The following are diagrammatically shown in.

Identical reference characters in the figures designate identical elements or elements that have the same effect.

DETAILED DESCRIPTION

Figure 1:
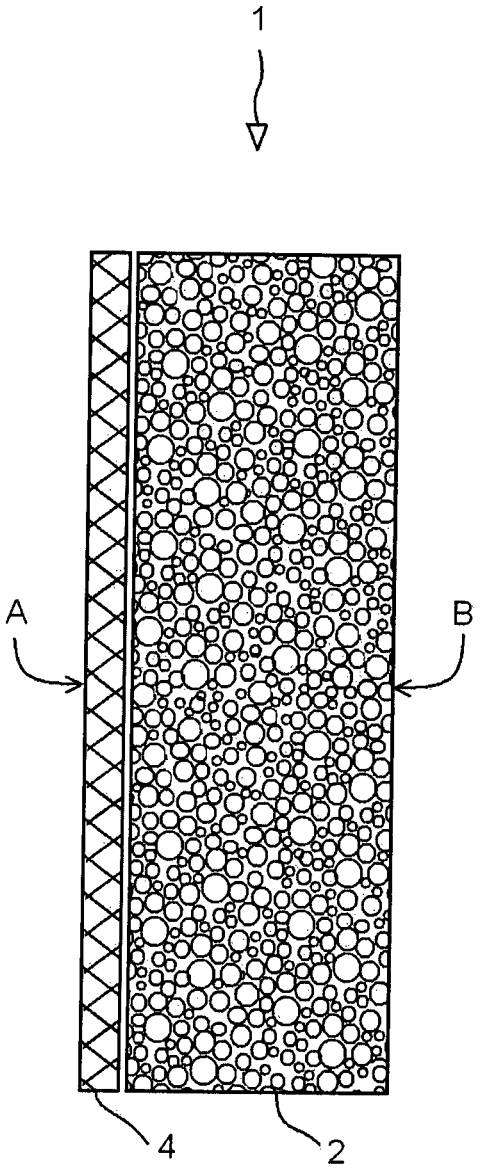
FIG. 1 a diagrammatic view of a ballistic multilayer arrangement with an absorption layer according to the invention and on the impact side an upstream fibre layer, FIG. 2 a diagrammatic view of a ballistic multilayer arrangement with an absorption layer according to the invention and on the impact side a downstream fibre layer, FIG. 3 a diagrammatic view of the absorption layer with expanded-glass granulate and the matrix enclosing the expanded-glass granulate, FIG. 4 a diagrammatic exemplary view of a cross-section of an expanded-glass granulate, FIG. 5 a diagrammatic view of a ballistic plate according to the state of the art, FIG. 6 a diagrammatic view of an exemplary ballistic multilayer arrangement with an absorption layer according to the invention according to a first variant, FIG. 7 a diagrammatic view of an exemplary ballistic multilayer arrangement with an absorption layer according to the invention according to a second variant, FIG. 8 a diagrammatic view of an exemplary ballistic multilayer arrangement with an absorption layer according to the invention according to a third variant, FIG. 9 a diagrammatic view of an exemplary ballistic multilayer arrangement with an absorption layer according to the invention according to a fourth variant with a spall layer, and FIG. 10 a diagrammatic view of an exemplary ballistic multilayer arrangement according to a fifth variant with a multiple absorption layer-sequence according to the invention.
Figure 2:
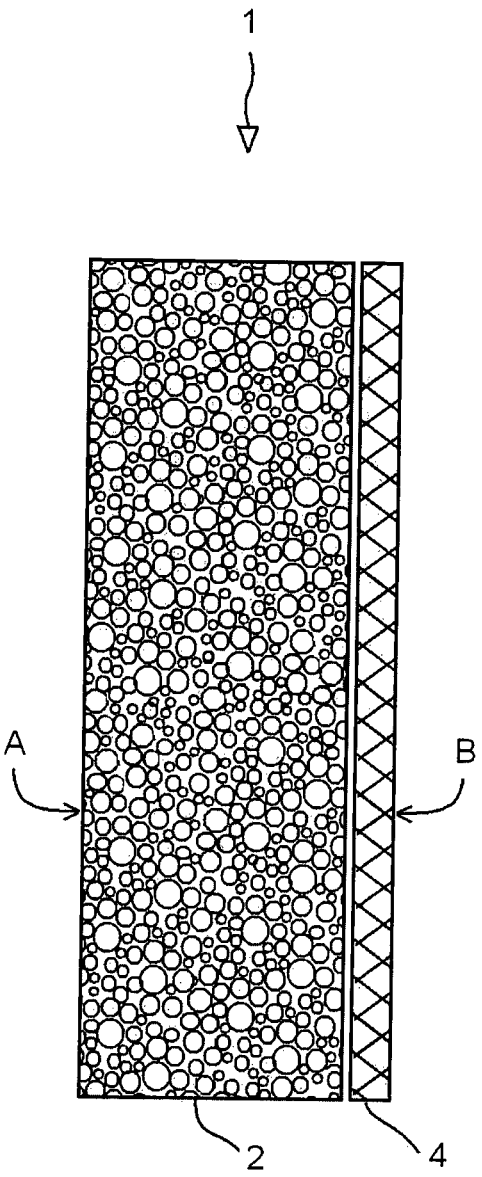

FIG. 1 shows a diagrammatic view of a ballistic multilayer arrangement 1 according to the invention. In this arrangement downstream of an aramid fibre layer 4, when viewed from the projectile impact side A, an absorption layer 2 in the form of a multilayer woven material is arranged. FIG. 2 shows an alternative arrangement with the sequence of the absorption layer 2 and the fibre layer 4 being the other way round.

In all the exemplary embodiments the layers are interconnected either mechanically or with the use of suitable adhesives.

Figure 3:
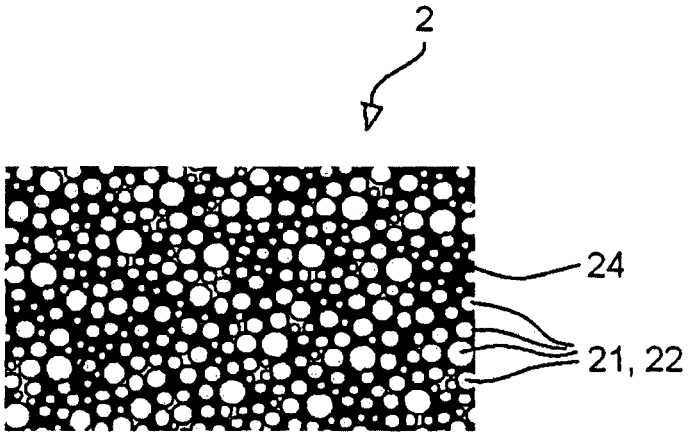

The absorption layer 2 comprises expanded glass 21 in the form of expanded-glass granulate 22 held in a dense packing by means of a matrix 24 enclosing the expanded-glass granulate, see FIG. 3. The matrix 24 is formed in an impact-resistant synthetic mixture. Good results have been achieved with impact-resistant polyurethane mixtures.

Expanded glass 21 is very light in weight and free of broken grains, highly thermally insulating, sound insulating, resistant to pressure, non-flammable, acid-proof and vermin-proof.

In the example the composition of the expanded-glass granulate 22 is as follows:

$SiO_2$ 71±2% weight by weight $Na_2O$ 13±1.5% weight by weight

CaO 8±2% weight by weight $Al_2O_3$ 2±1.3% weight by weight

MgO 2±1% weight by weight $K_2O$ 1±0.2% weight by weight and $Fe_2O_3$ 0.5±0.2% weight by weight trace elements<0.5% weight by weight.

Figure 4:
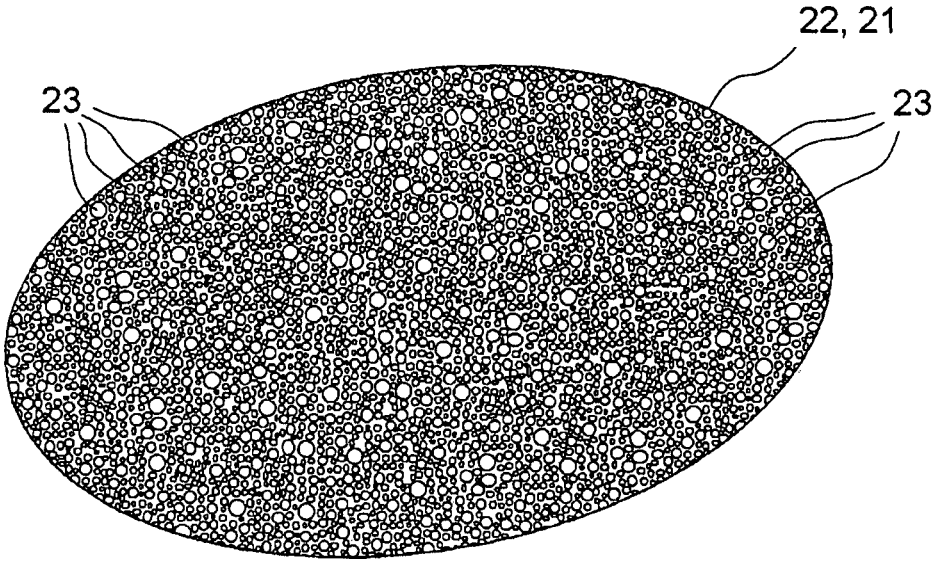
Figure 5:
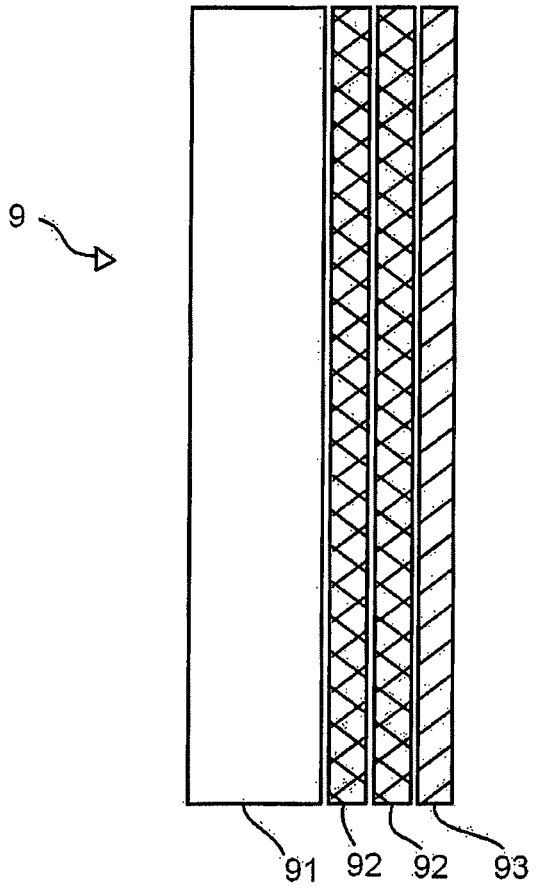
Fig. 5 (Prior Art)

The granulate 22 itself can be of a closed-pore or of an open-pore nature, with a granulate size of 0.01 mm to 5 mm. As is shown as an example in cross section in FIG. 4, the foamed expanded-glass granulate 22 has a bubble size 23 of 0.001-0.5 mm.

Depending on the configuration of the energy to be absorbed, the layer thickness of the absorption layer can be between 0.5 and 50 mm.

In the examples the fibre layers 4 (41, 42, 43) are multilayer woven materials comprising aramid fibres. However, it is also possible to use comparable fibres.

It is imaginable to design the arrangement according to FIG. 1 or 2 so that it is elastic, and to select the matrix of the absorption layer correspondingly so that manufacture of the ballistic multilayer arrangement as a mat or blanket is possible. Thus secure tents or curtains and the like are possible.

Figure 6:
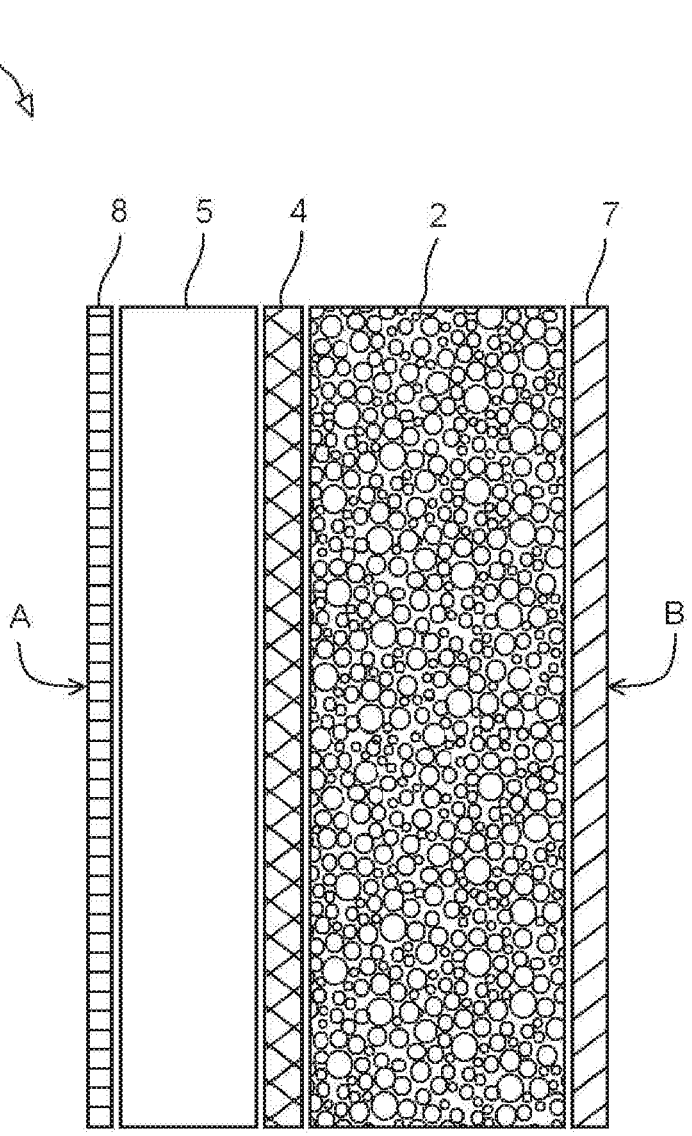

FIG. 6 shows an exemplary design of a ballistic multilayer arrangement 1 as a plate with an absorption layer 2.

The layer sequence viewed from the direction of the impact side A is as follows. On the outside first a synthetic cover layer 8 is provided. This cover layer 8 is used as a finish towards the outside and ensures that any shattered components of the subsequent very hard first ceramic layer 5 do not fall out following a hit by a projectile, and that the structure is held together even in the case of cracks in the ceramic layer 5 should a further hit in the surroundings of an impact occur.

In this arrangement in the sense of the invention the ceramic layer 5 can also comprise other materials such as fine stone or natural stone or a ceramic mixture or a ceramic-metal mixture in plate-shape.

It is important that the "ceramic" layer 5 is hard. This can be provided either by classical ceramics or by substitute materials such as very hard natural stone (granite etc.) or fine stone, which is very hard high-fired stoneware.

The ceramic layer 5 is followed by a fibre layer 4 of woven aramide materials. This is followed by the absorption layer 2, which is able to absorb the energy of the projectile or fragment. In the absorption layer a great deal of energy is absorbed by the projectile and in its further path is distributed to a much wider base so that after this a metal plate 7 is sufficient as a final layer.

Figure 7:
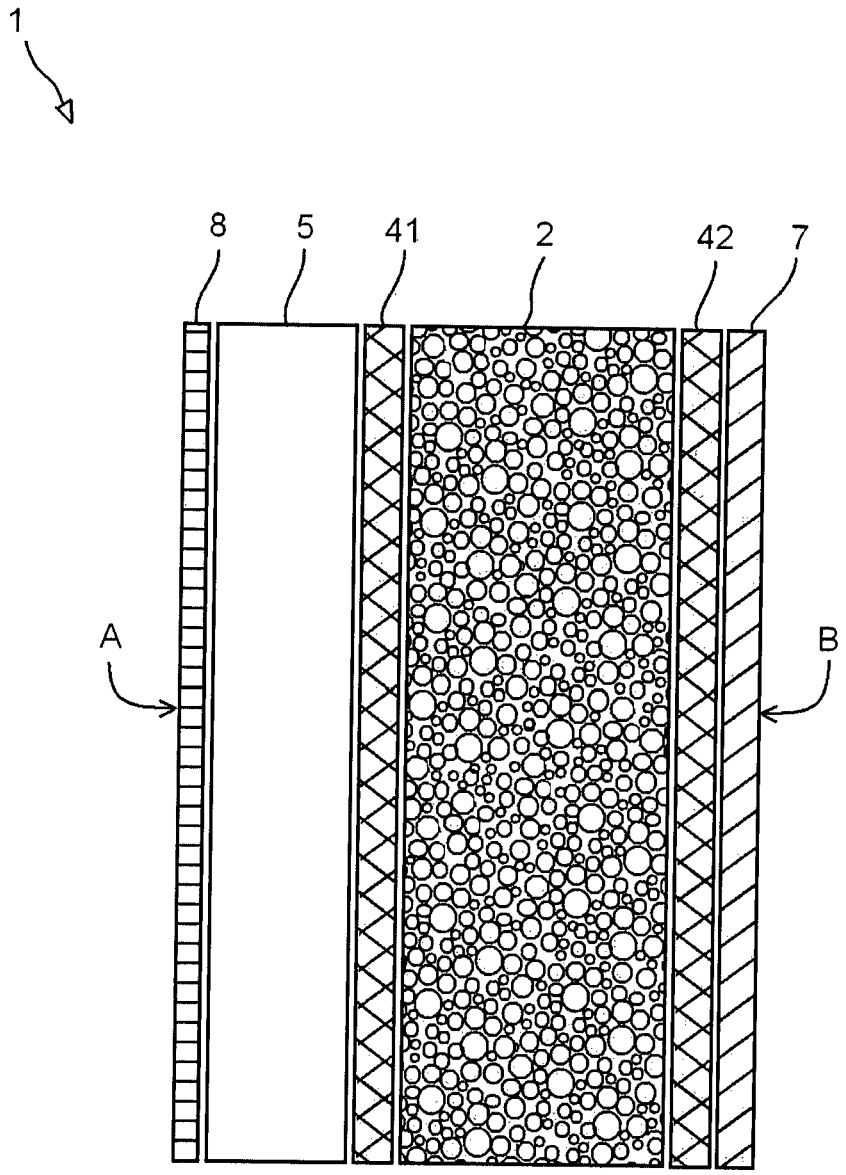

If even higher energies are input or if for reasons of weight reduction the layer thicknesses are selected so as to be thinner, according to FIG. 7 it is also possible to implement a variant in which in front of the steel plate 7 after a first fibre layer 41 immediately in front of the aforesaid a second fibre layer 42 is provided.

Figure 8:
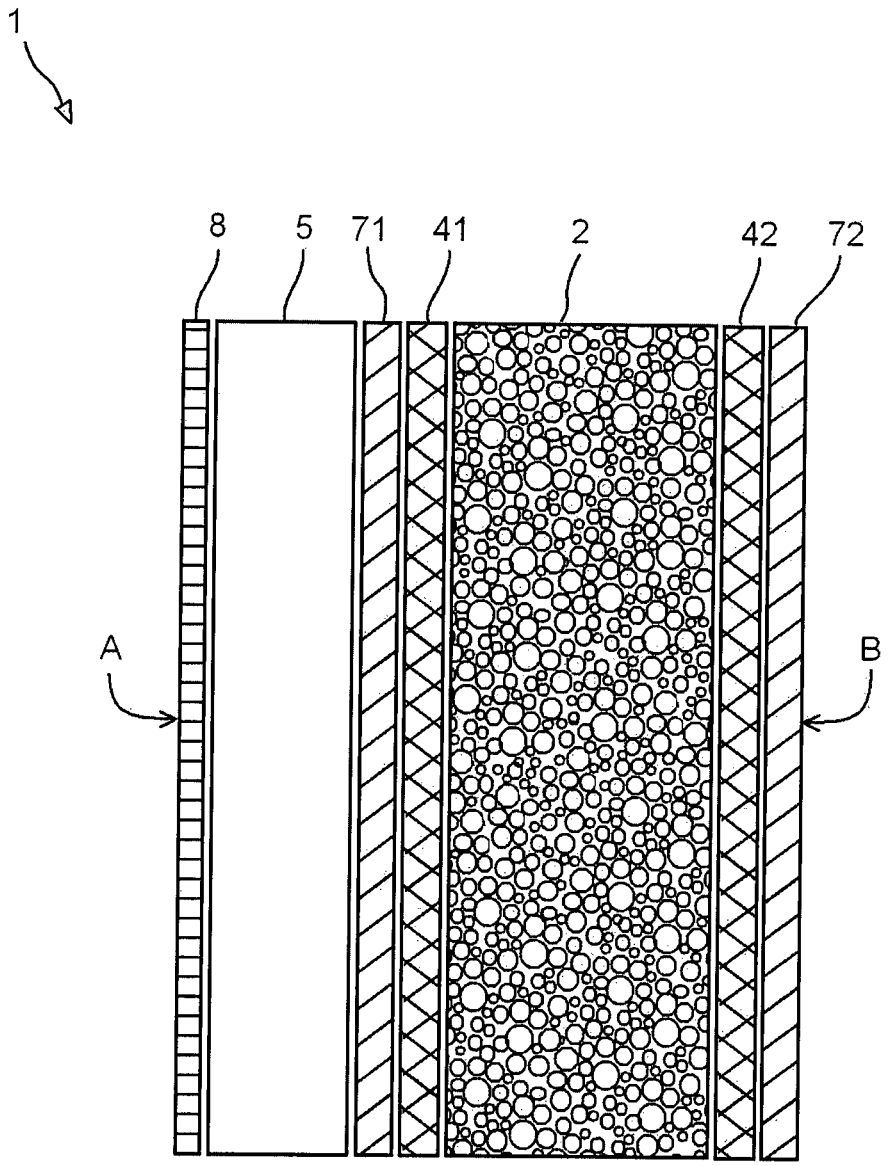

FIG. 8 shows a further modification, when compared to the embodiment of FIG. 7, in which after the ceramic layer 5 a first steel plate 71 has been installed. This steel plate 71 additionally stabilises the ceramic layer in the immediate surroundings of an impact. This can be advantageous in the case of multiple projectile entry. In the example shown, too, a steel plate 72 is provided on the back B. Said steel plate 72 can already be designed as a lightly armoured outer wall of a vehicle or as a normal outer wall.

Figure 9:
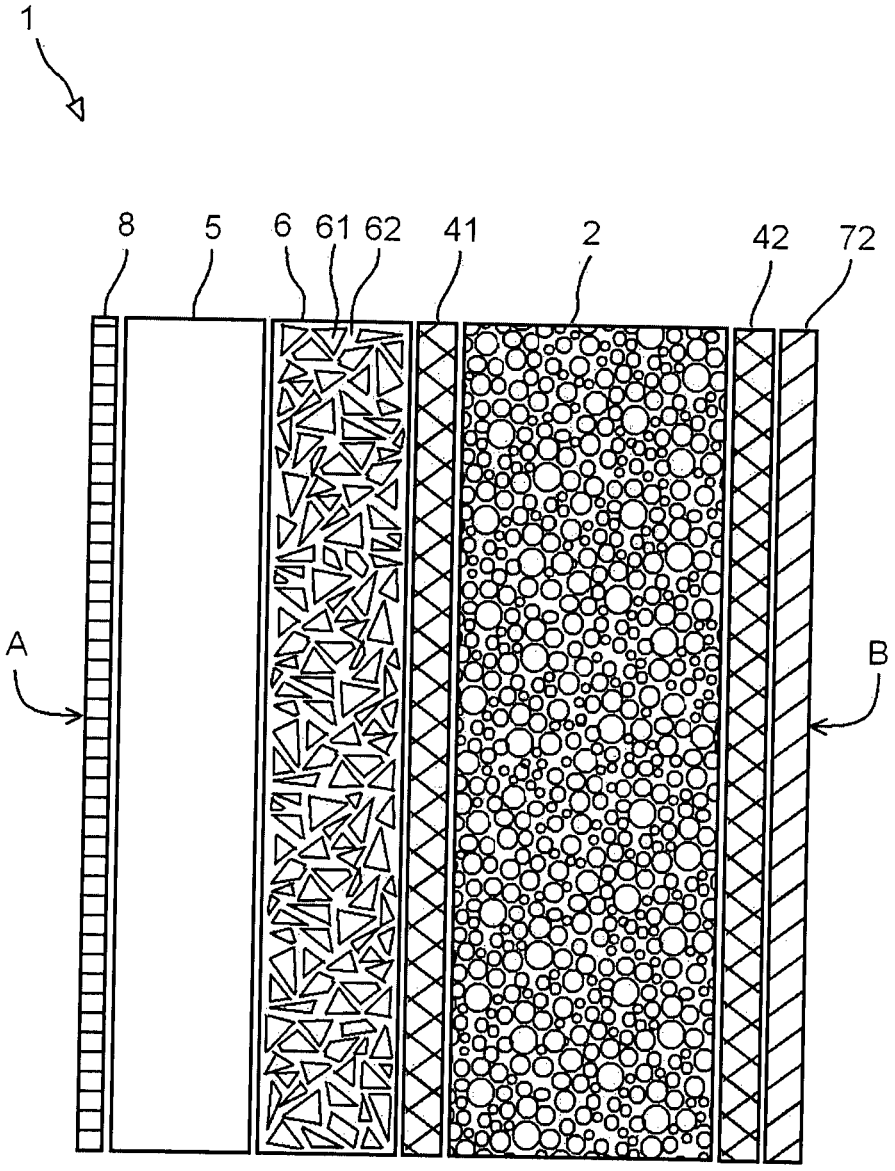

FIG. 9 shows a further modification. In this case the ceramic layer 5 is followed by a spall layer 6 that comprises ceramic spalls or ceramic-metal spalls or fine stone spalls or natural stone spalls 61 bound in a matrix 62. In this design it is not so much the layer sequence that is the essential characteristic, but rather the presence of a spall layer bound in a matrix, which spall layer comprises a loose fill of very hard spalls that deflect a projectile or a hard projectile core (for example tungsten carbide).

Figure 10:
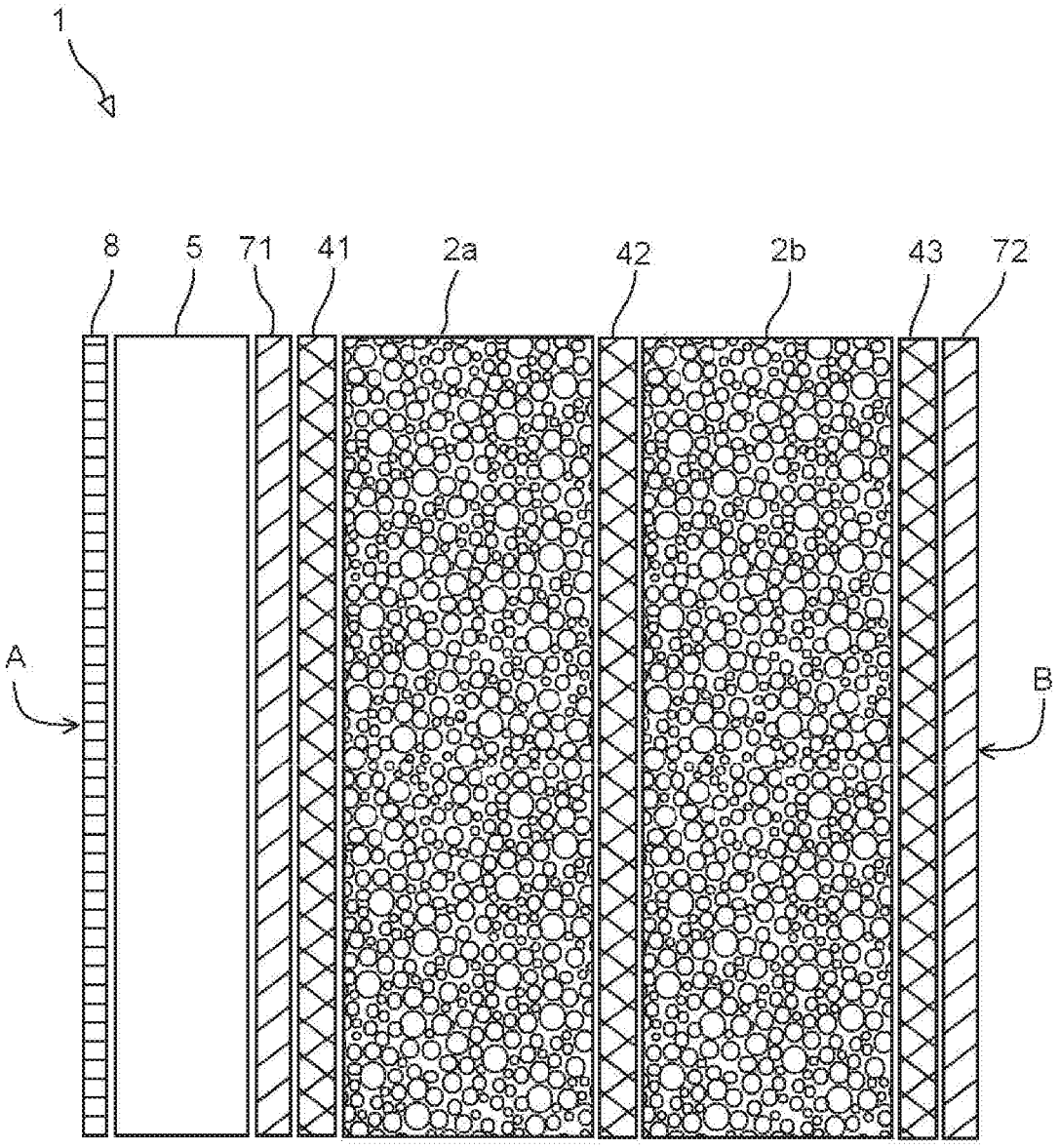

The example according to FIG. 10 shows an arrangement with two successive absorption layers 2*a* and 2*b*, separated from each other by a fibre layer 42. In the example shown both absorption layers 2*a* and 2*b* are situated adjacent to a further fibre layer 41 and 43 and following on from this comprise a steel plate 71 and 72.

The layers as shown in the above examples can also be arranged in some other sequence, with some layers being left out or arranged multiple times.

In the use of the absorption layers according to the invention it is also very advantageous that said layers provide outstanding thermal insulation characteristics. Thus vehicles, structures or tents can be thermally insulated from the outside world against heat or cold, without this requiring a further layer or some other measures.

Likewise the design of the absorption layer according to the invention is sound insulating. This characteristic, too, is advantageous in the proposed application.

LIST OF REFERENCE CHARACTERS

1 Ballistic multilayer arrangement
A Impact side
B Back
2 Absorption layer
2*a*, 2*b* Absorption layer
21 Expanded glass
22 Expanded-glass granulate
23 Bubbles
24 Matrix
4 Fibre layer
41 Fibre layer
42, 43 Fibre layer
5 Ceramic plate
6 Spall layer
61 Spalls
62 Matrix
7 Metal plate
71, 72 Metal plate
8 Synthetic cover layer
9 Ballistic plate (state of the art)
91 Ceramic plate
92 Fibre layer
93 Steel plate

The invention claimed is:

1. A ballistic layer for a ballistic multilayer arrangement, the ballistic layer being formed by an absorption layer including expanded glass held in a matrix including a synthetic resin, wherein the expanded glass is present in the form of sintered expanded-glass granulate, and the sintered expanded-glass granulate is held in a dense packing or fill by the matrix that encloses the sintered expanded-glass granulate.

2. The ballistic layer according to claim 1, wherein the expanded-glass granulate comprises a granulate size of 0.01 mm to 5 mm.

3. The ballistic layer according to claim 1, wherein the expanded glass comprises $SiO_2$.

4. The ballistic layer according to claim 3, wherein as further ingredients the expanded glass comprises $Na_2O$ and CaO.

5. The ballistic layer according to claim 3, wherein as further ingredients the expanded glass comprises below 10 percent weight by weight of $Al_2O_3$and/or MgO and/or $K_2O$.

6. The ballistic layer according to claim 1, wherein the matrix comprises a mixture of synthetic material/synthetic resin.

7. The ballistic layer according to claim 6, wherein the synthetic material mixture comprises polyurethane and/or polyethylene and/or epoxy resin and/or silicon and/or an impact-proof synthetic material and/or an impact-resistant synthetic material.

8. A ballistic multilayer arrangement including a plurality of layers and having with an impact side (A) and a back side (B), wherein at least one of the layers includes a ballistic layer according to claim 1, and wherein at least one of the layers is formed by a multilayer fibre layer comprising layers of aramid fibres or comparable fibres, wherein said multilayer fibre layer is designed in the form of a woven material or a multilayer woven material.

9. The ballistic multilayer arrangement according to claim 8, wherein at least one of the plurality of layers is formed by a plate comprising fine stone or natural stone or ceramic or a ceramic mix.

10. The ballistic multilayer arrangement according to claim 8, wherein at least one of the plurality of layers is a spall layer comprising spalls of ceramic or ceramic metal or fine stone or natural stone, which spalls are bound in a matrix.

11. The ballistic multilayer arrangement according to claim 8, wherein at least one of the plurality of layers is formed by a metal plate.

12. The ballistic multilayer arrangement according to claim 8, wherein at least one of the plurality of layers is formed by a tenacious synthetic layer.

13. The ballistic multilayer arrangement according to claim 12, wherein the tenacious synthetic layer forms the matrix of the absorption layer.

14. The ballistic multilayer arrangement according to claim 8, wherein said arrangement is surrounded by a synthetic cover layer or a fibre-reinforced synthetic braiding layer at least on one of the impact side (A) and the back side (B).

15. The ballistic multilayer arrangement according to claim 8, wherein the plurality of layers are arranged in a layer sequence and in the layer sequence the absorption layer is followed at least on one of the absorption layer by a fibre layer.

16. The ballistic multilayer arrangement according to claim 8, wherein the arrangement is designed so as to be flexible as a mat or a blanket.

17. The ballistic multilayer arrangement according to claim 8, wherein the arrangement is designed as a rigid plate.

18. The ballistic multilayer arrangement according to claim 8, wherein a ceramic layer, a fibre layer and a metal layer are provided.

19. The ballistic multilayer arrangement according to claim 8, wherein the plurality of layers are arranged in a layer sequence and the layer sequence is selected as follows:

an enveloping layer, a ceramic layer followed by a metal layer, a fibre layer and an absorption layer, a metal layer.

* * * * *